US009451365B2

(12) United States Patent
Takada et al.

(10) Patent No.: US 9,451,365 B2
(45) Date of Patent: Sep. 20, 2016

(54) VOICE COIL SPEAKER

(75) Inventors: Naoki Takada, Saitama (JP); Hiroyuki Tanaka, Saitama (JP); Kenji Kono, Saitama (JP); Masayoshi Uehara, Saitama (JP)

(73) Assignee: CLARION CO., LTD., Saitama (JP)

( * ) Notice: Subject to any disclaimer, the term of this patent is extended or adjusted under 35 U.S.C. 154(b) by 613 days.

(21) Appl. No.: 13/637,728

(22) PCT Filed: Feb. 14, 2011

(86) PCT No.: PCT/JP2011/000795

§ 371 (c)(1),
(2), (4) Date: Sep. 27, 2012

(87) PCT Pub. No.: WO2011/125276

PCT Pub. Date: Oct. 13, 2011

(65) Prior Publication Data

US 2013/0022219 A1 Jan. 24, 2013

(30) Foreign Application Priority Data

Apr. 9, 2010 (JP) ..... 2010-090083

(51) Int. Cl.
*H04R 9/04* (2006.01)
*H04R 1/06* (2006.01)

(52) U.S. Cl.
CPC ..... *H04R 9/046* (2013.01); *H04R 1/06* (2013.01); *H04R 2209/041* (2013.01)

(58) Field of Classification Search
USPC ..... 381/120, 400, 396, 401, 409, 410, 416, 381/302; 455/552.1, 41.1, 550.1; 703/2; 345/102
See application file for complete search history.

(56) References Cited

U.S. PATENT DOCUMENTS

| | | | | |
|---|---|---|---|---|
| 4,897,877 | A * | 1/1990 | Tetzlaff | 381/302 |
| 6,134,332 | A * | 10/2000 | Wiener | 381/160 |
| 2005/0271241 | A1* | 12/2005 | Watanabe | 381/407 |
| 2005/0276436 | A1* | 12/2005 | Kobayashi et al. | 381/409 |
| 2006/0291673 | A1* | 12/2006 | Kitazawa et al. | 381/117 |
| 2009/0110217 | A1 | 4/2009 | Yasuda et al. | |

(Continued)

FOREIGN PATENT DOCUMENTS

| | | | |
|---|---|---|---|
| CN | 101542909 | A | 9/2009 |
| JP | 01-149191 | U | 10/1989 |

(Continued)

OTHER PUBLICATIONS

English translation of International Preliminary Report on Patentability (Chapter I) dated Nov. 15, 2012.

(Continued)

*Primary Examiner* — Md S Elahee
(74) *Attorney, Agent, or Firm* — Posz Law Group, PLC

(57) ABSTRACT

There is provided a voice coil speaker containing a bobbin having multilayer voice coils formed thereon in which the bobbin and a circuit board are properly arranged. In a voice coil speaker equipped with a bobbin having multilayer voice coils formed thereon and a diaphragm connected to the bobbin, the bobbin and the diaphragm being provided in a speaker body, an audio signal processing circuit board for processing an audio signal is disposed ahead of the diaphragm, and plural output terminals for outputting to the multilayer voice coils are arranged in the peripheral direction of the audio signal processing circuit board.

20 Claims, 4 Drawing Sheets

(56) References Cited

U.S. PATENT DOCUMENTS

| | | | | |
|---|---|---|---|---|
| 2010/0239101 | A1* | 9/2010 | Okamura et al. | 381/71.1 |
| 2010/0316249 | A1* | 12/2010 | Kamimura et al. | 381/399 |
| 2013/0058497 | A1 | 3/2013 | Okamura et al. | |

FOREIGN PATENT DOCUMENTS

| | | | |
|---|---|---|---|
| JP | H03-111095 | U | 11/1991 |
| JP | H05-085196 | U | 11/1993 |
| JP | 10-051895 | A | 2/1998 |
| JP | 10-285690 | A | 10/1998 |
| JP | 2000-350275 | A | 12/2000 |
| JP | 2005-277876 | A | 10/2005 |
| JP | 2009-147928 | A | 7/2009 |
| JP | 2010-028784 | A | 2/2010 |
| JP | 2010-028785 | A | 2/2010 |

OTHER PUBLICATIONS

Office Action dated Dec. 18, 2014 issued in corresponding CN patent application No. 201180018145.9 (and English translation).

Office Action mailed Mar. 10, 2015 issued in corresponding JP patent application No. 2014-113784 (and English translation).

Office Action issued on Jul. 3, 2014 for corresponding CN patent application No. 201180018145.9 (and English translation).

International Search Report of the International Searching Authority mailed Mar. 8, 2011 for the corresponding international application No. PCT/JP2011/000795 (with English translation).

Office Action mailed Feb. 18, 2014 issued in corresponding JP patent application No. 2010-090083 (and English translation).

* cited by examiner

VOICE COIL SPEAKER

CROSS REFERENCE TO RELATED APPLICATIONS

This application is a U.S. national stage application of PCT/JP2011/000795 filed on Feb. 14, 2011, and claims priority to, and incorporates by reference, Japanese Patent Application No. 2010-090083 filed on Sep. 4, 2010.

TECHNICAL FIELD

The present invention relates to a voice coil speaker equipped with a bobbin having a multilayer voice coil formed therein, and a diaphragm connected to the bobbin.

BACKGROUND ART

A speaker (digital speaker) equipped with a bobbin having a multilayer voice coil formed therein has been hitherto proposed (see Patent Document 1, for example). In this type speaker, a circuit board for audio signal processing is connected to each voice coil through a tinsel wire, and an audio signal is output from the circuit board through the tinsel wire to each voice coil, whereby the bobbin having the voice coils formed therein is vibrated and voices are output by vibration of a diaphragm which is based on the vibration of the bobbin.

PRIOR ART DOCUMENT

Patent Document

Patent Document 1: JP-A-2010-28785

SUMMARY OF THE INVENTION

Problem to be Solved by the Invention

In the speaker as described above, the multilayer voice coil is formed in the bobbin, and thus plural tinsel wires connected to the respective voice coils exist. Therefore, it is necessary to properly design the positional relationship between the bobbin and the circuit board while reflecting the structure of the speaker so as to prevent the respective tinsel wires from interfering with one another or the like.

The present invention has been implemented in view of the foregoing situation, and has an object to provide a voice coil speaker in which a bobbin and a circuit board are properly arranged in a voice coil speaker equipped with a bobbin having a multilayer voice coil formed therein.

Means of Solving the Problem

In order to attain the above object, according to the present invention, a voice coil speaker equipped with a bobbin having multilayer voice coils formed thereon and a diaphragm connected to the bobbin, the bobbin and the diaphragm being provided in a speaker body, is characterized in that a circuit board for processing an audio signal is disposed ahead of the diaphragm, and plural output terminals for outputting to the multilayer voice coils are arranged in a peripheral direction of the circuit board.

Here, in the voice coil speaker according to the present invention, the plural output terminals may be arranged so as to be spaced from one another at an equal interval in the peripheral direction of the circuit board.

In the voice coil speaker according to the present invention, the plural output terminals may be arranged on substantially the same circle so as to be spaced from one another at an equal interval.

In the voice coil speaker according to the present invention, a damper may be provided between the bobbin and a frame for supporting the circuit board, and tinsel wires may be provided so as to extend from the plural output terminals of the circuit board along the damper to the multilayer voice coils formed on the bobbin.

In the voice coil speaker according to the present invention, the tinsel wires for connecting the output terminals and the voice coils may be interwoven with the damper.

In the voice coil speaker according to the present invention, the tinsel wires may be radially interwoven with the damper.

In the voice coil speaker according to the present invention, the circuit board may be covered by a shield cover.

In the voice coil speaker according to the present invention, an amplifier circuit for amplifying an audio signal may be mounted on the circuit board.

In the voice coil speaker according to the present invention, multi-channel audio digital signals are input to the circuit board.

In the voice coil speaker according to the present invention, the band-shaped frame may be bridged ahead of the speaker body so that the circuit board is supported by the frame.

In the voice coil speaker according to the present invention, a tweeter may be disposed ahead of the circuit board.

Effect of the Invention

According to the present invention, there is provided a voice coil speaker equipped with a bobbin having a multilayer coil voice formed therein in which the bobbin and a circuit board are properly arranged.

BRIEF DESCRIPTION OF THE DRAWINGS

FIG. 1 is a diagram showing a voice coil speaker, wherein FIG. 1(A) is a front view, and FIG. 1(B) is an A-O-B cross-sectional view of FIG. 1(A).

MODE FOR CARRYING OUT THE INVENTION

An embodiment according to the present invention will be described hereunder with reference to the drawings.

Figure 1:
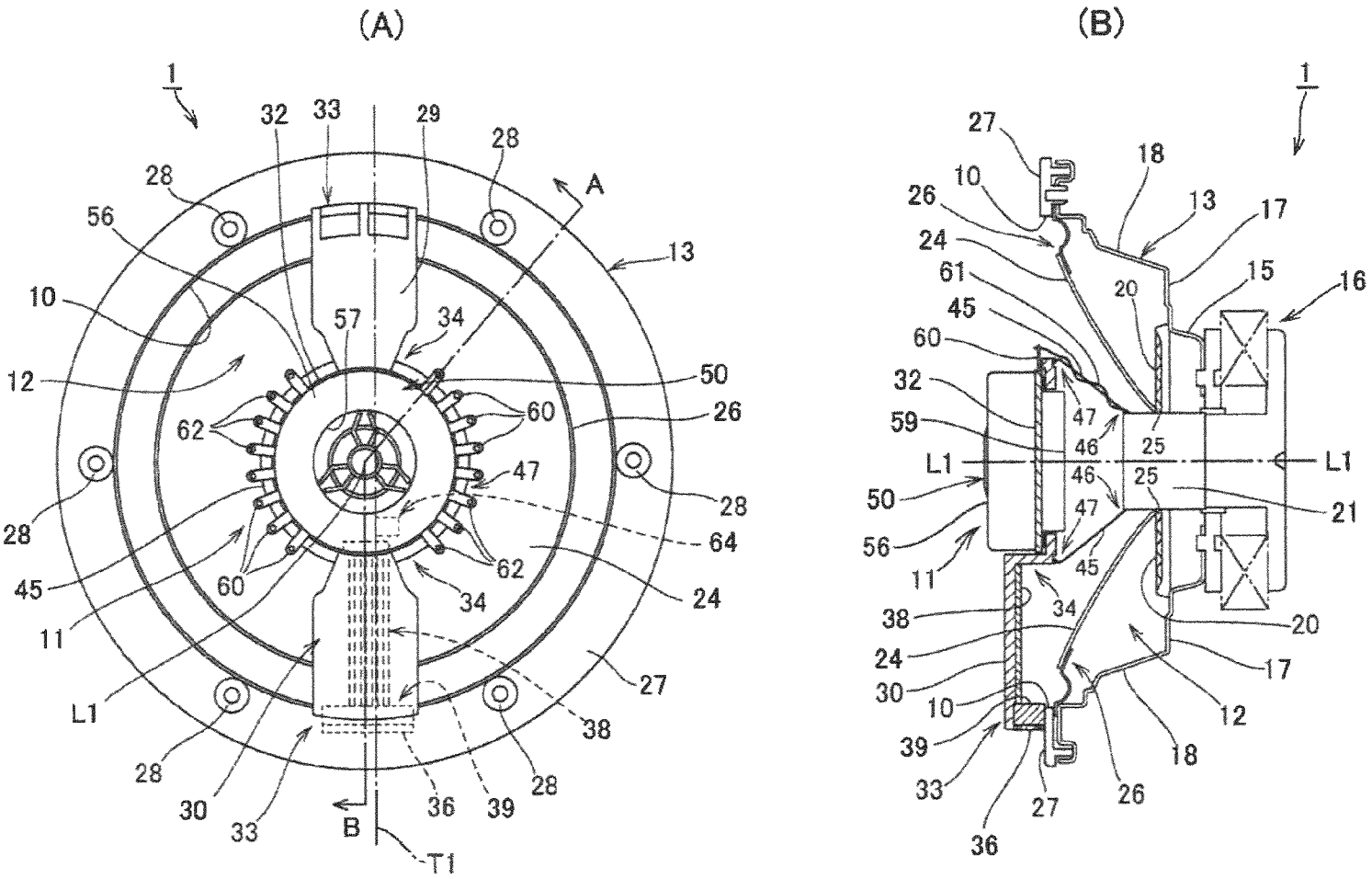
Figure 2:
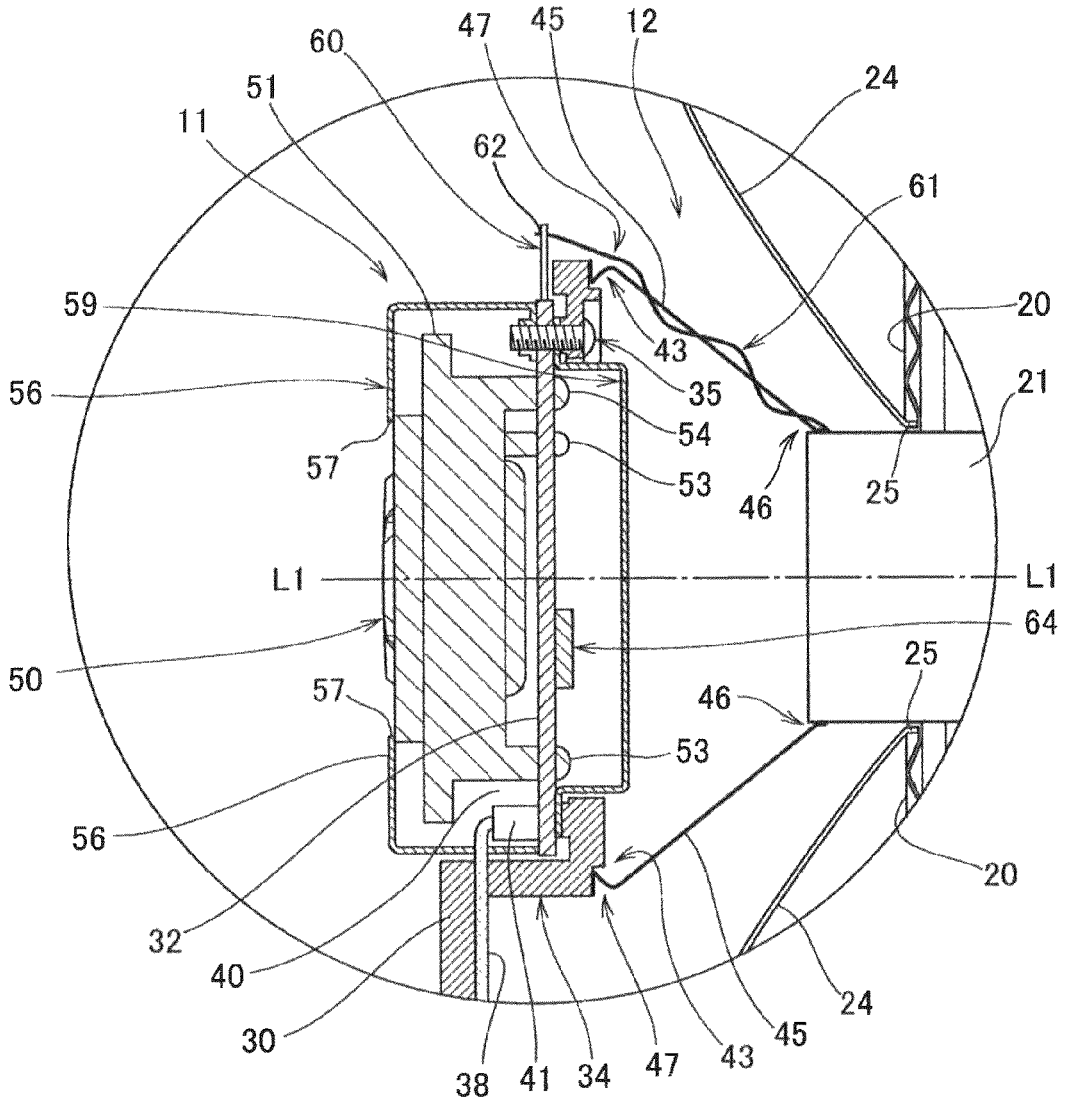
FIG. 2 is an enlarged view showing a main part in FIG. 1(B).

FIG. 1 is a diagram showing a voice coil speaker 1 according to an embodiment, wherein FIG. 1(A) is a front view and FIG. 1(B) is an A-O-B cross-sectional view of FIG. 1(A). FIG. 2 is an enlarged view showing a main part in FIG. 1(B). In the figures, reference character L1 represents the center axis of the voice coil speaker 1.

The voice coil speaker 1 according to this embodiment is a speaker which is secured to the side face of a door of a vehicle and supplied with a digital audio signal from an in-vehicle mount audio to output voices on the basis of the digital audio signal.

As shown in FIG. 1, the voice coil speaker has a circular speaker opening 10 at the front surface thereof, and has a hollow cylindrical speaker frame 13 having a bottom (frame) in which a speaker body mount portion 12 corresponding to a space for accommodating a speaker body 11 is formed.

A cup-like frame rear portion 15 (FIG. 1(B)) which increases in diameter as the position thereof shifts to the front side thereof and has a circular opening at the front surface thereof is formed at the rear portion of the speaker frame 13. A magnetic circuit portion 16 (FIG. 1(B)) for driving the speaker body 11 is provided at the rear side of the frame rear portion 15.

An annular frame flat portion 17 (FIG. 1(B)) which is coaxial with the center axis L1 of the voice coil speaker 1 is formed in the speaker frame 13 so as to extend outwards from the edge of a circular opening formed at the front surface of the frame rear portion 15 along the peripheral direction of the opening. The outer periphery of the frame flat portion 17 is connected to the base end of a hollow cylindrical frame barrel portion 18 which increases in diameter as the position thereof shifts to the front side and has a circular speaker opening 10 at the front surface thereof.

A main dumper 20 is connected to the edge of the circular opening formed at the front surface of the frame rear portion 15 so as to block the opening concerned. A cylindrical bobbin 21 extending in the same axial direction as the center axis L1 of the voice coil speaker 1 is supported at the center of the main dumper 20, whereby the bobbin 21 is supported and fixed to the speaker frame 13. The main dumper 20 and the bobbin 21 are coaxially arranged so that the center axis thereof is coincident with the center axis L1 of the voice coil speaker 1.

Figure 3:
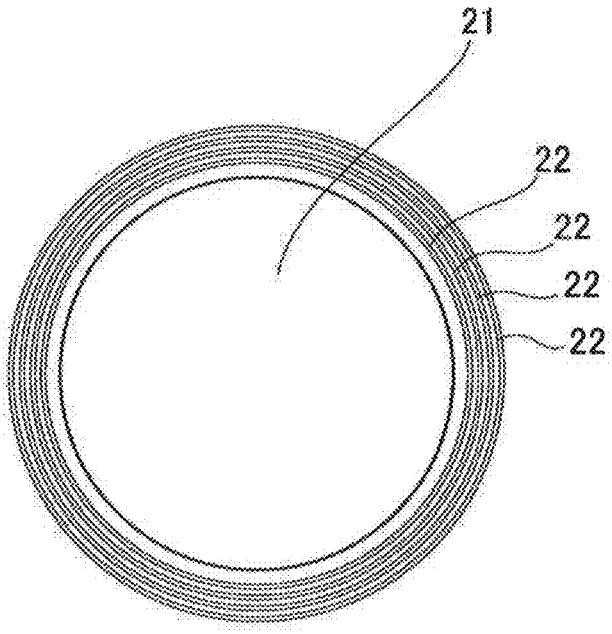
FIG. 3 is a diagram schematically showing a bobbin and a voice coil.

FIG. 3 is a top view of the bobbin 21. In FIG. 3, in order to clarify the relationship between the bobbin 21 and voice coils 22, the bobbin 21 and the voice coils 22 are schematically illustrated while the shapes thereof are simplified.

As shown in FIG. 3, the bobbin 21 holds plural voice coils 22 which are formed by alignment-winding tinsel wires formed of wire rods such as copper wires or the like in the axial direction of the bobbin 21. In this embodiment, the plural voice coils 22 are provided to be stacked as a multilayer in the peripheral direction of the bobbin 21. Each voice coil 22 of each layer is connected to each tinsel wire 61 described later, and each voice coil 22 of each layer makes the bobbin vibrate on the basis of a driving signal input from the tinsel wire 61.

Figure 4:
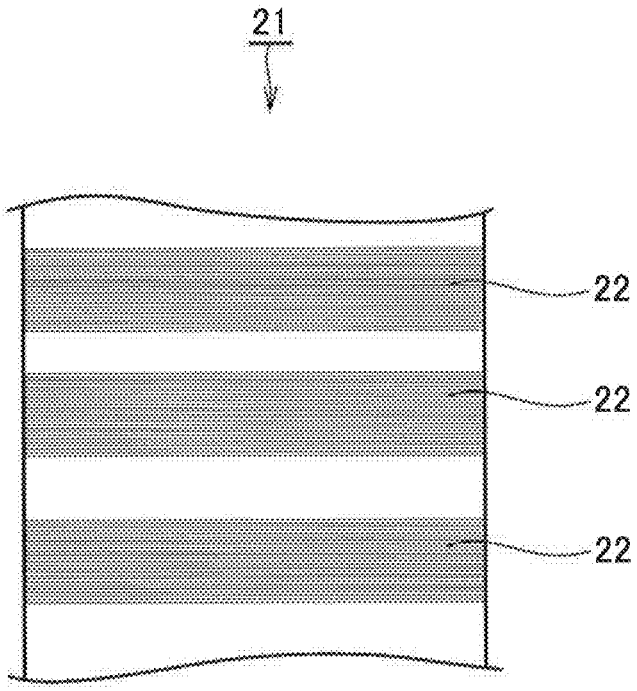
FIG. 4 is a diagram schematically showing other examples of the bobbin and the voice coil.

FIG. 4 is a side view of another example of the bobbin 21. In FIG. 4, in order to clarify the relationship between the bobbin 21 and the voice coils 22, the bobbin 21 and the voice coils 22 are schematically illustrated while the shapes thereof are simplified as in the case of FIG. 3.

As shown in FIG. 4, the bobbin 21 holds multilayer voice coils 22 formed by winding tinsel wires formed of wire rods such as copper wires or the like in a multilayer structure. In this example, plural voice coils 22 are formed to be spaced from one another every layer in the axial direction of the bobbin 21 (=the axial direction of the center axis L1 of the voice coil speaker 1). Each voice coil 22 of each layer is connected to a tinsel wire 61 described later, and each voice coil 22 of each layer formed on the bobbin 21 makes the bobbin 21 vibrate on the basis of a driving signal associated with voices to be output.

A base portion 25 (FIG. 1(B), FIG. 2) of a conical diaphragm 24 which increases in diameter as the position thereof shifts to the front side is connected to the bobbin 21, and the outer periphery of the tip portion 26 of the diaphragm 24 is connected to the inner periphery of the speaker opening 10 formed at the front face of the frame cylinder portion 18 of the speaker frame 13. The diaphragm 24 vibrates in accordance with vibration of the bobbin 21 which is caused by the multilayer voice coils 22, and sounds are output on the basis of the vibration of the diaphragm 24.

The outer periphery of the speaker opening 10 formed at the front face of the frame cylinder portion 18 is provided with an annular frame flange 27 which extends outwards from the edge of the outer periphery along the peripheral direction of the opening, and plural screw holes 28 (FIG. 1(A) are formed in the frame flange 27. When the voice coil speaker 1 is fixed to the side surface of a door of the vehicle, the voice coil speaker 1 is fixed to the door through the screw holes 28 by screws.

Two bridges 29 and 30, that is, an upper bridge 29 and a lower bridge 30 are fixedly connected to the frame flange 27, and a disc type audio signal processing circuit board 32 (circuit board) is positioned and supported ahead of the diaphragm 24 by the two bridges 29 and 30 so that the center axis thereof is coincident with the center axis L1 of the voice coil speaker 1.

More specifically, as shown in FIG. 1, the two bridges 29 and 30 are configured as tabular members, and the respective base end portions 33 thereof are firmly fixed to the frame flange 27 under the state that the two bridges 29 and 30 are arranged symmetrically with respect to the center axis L1. The audio signal processing circuit board 32 is fixed to the respective tip portions 34 of the bridges 29 and 30 substantially at the center of the speaker opening 10 by screws 35 (FIG. 2), whereby the audio signal processing circuit board 32 is supported and fixed to the speaker frame 13 through the two bridges 29 and 30. As described above, according to this embodiment, the audio signal processing circuit board 32 is disposed ahead of the diaphragm 24, thereby effectively and actively using a space ahead of the diaphragm 24.

Furthermore, a connector 36 to which external equipment as an output source for audio signals such as an in-vehicle mount audio device or the like is connected is provided to the base end portion 33 of the lower bridge 30. One ends 39 (FIG. 1) of plural lead lines 38 are connected to the connector 36, and these plural lead lines 38 linearly extend to the audio signal processing circuit board 32 along the back surface of the lower bridge 30 while fixed in close contact with the back surface of the lower bridge 30. The plural lead lines 38 are connected to the audio signal processing circuit board 32 through a circuit connection connector 41 (FIG. 2) at the other end 40 (FIG. 2). As described above, the lead lines 38 are disposed on the back surface of the lower bridge 30. Therefore, the lead lines 38 are not exposed to enhance the exterior appearance, and also the contact to the lead wires 38 can be prevented at maximum.

Still furthermore, the connector 36 is a member to which the external equipment is connected, and thus it is provided to the outer edge portion of the voice coil speaker 1 in consideration of easiness of the connection to the external equipment. In this embodiment, the connector 36 is provided in the neighborhood of the base end portion 33 of the lower bridge 30, and the lead lines 38 interposed between the connector 36 and the audio signal processing circuit board 32 are configured to extend linearly by using the lower bridge 30 as a member indispensable to support the audio signal processing circuit board 32. Therefore, the length of the lead lines 38 can be shortened, and flexure, etc. of the lead lines 38 can be prevented.

The bridges 29 and 30 are members having the same function as the speaker frame 13 which fixes the audio signal processing circuit board 32, and they are conceptually contained in the speaker frame 13.

In the bridges 29 and 30, a tip portion 47 of a sub damper 45 (damper) is connected to the position corresponding to a circuit fixing portion 43 (FIG. 2) as a site to which the audio signal processing circuit board 32 is connected by screws. As shown in FIG. 1(B) and FIG. 2, the sub damper 45 is a conical member which increases in diameter as the position thereof shifts to the front side. The base end portion 46 is connected to the bobbin 21, and the tip portion 47 is connected to the bridges 29 and 30 which supports the audio signal processing circuit board 32. The sub damper 45 fixes the bobbin 21 to the speaker frame 13 through the bridges 29, 30, and also properly keeps the positions of the respective members of the bobbin 21, the audio signal processing circuit board 32 and a tweeter 50 (described later) so that these members are arranged on the same axis.

The tweeter 50 is provided at the front side of the audio signal processing circuit board 32. The tweeter is a speaker for outputting sounds having strong directivity and a high sound range, and it has a yoke 51 (FIG. 2), a magnet mounted in the yoke 51, a bobbin loosely-inserted in a magnetic gap formed between the yoke 51 and the magnet, a voice coil wound around the bobbin, a diaphragm connected to the bobbin, etc. In this embodiment, as shown in FIG. 2, the tweeter 50 is firmly fixed to the audio signal processing circuit board 32 by screws 53, and also a terminal 54 extending rearwards from the tweeter 50 is directly inserted in a through hole of the audio signal processing circuit board 32 and soldered to be conducted to the audio signal processing circuit board 32. Accordingly, the physical and electrical connection can be easily and surely performed. A driving signal is input from the audio signal processing circuit board 32 through the terminal 54 to the voice coil to vibrate the diaphragm, whereby the tweeter 50 outputs sounds.

A box-shaped front shield cover 56 covering the tweeter 50 is provided to the front side of the audio signal processing circuit board 32, whereby the tweeter 50 and the respective circuits mounted on the front face of the audio signal processing circuit board 32 are protected. A cut-out 57 for properly outputting sounds from the tweeter 50 is formed substantially at the center of the front face of the front shield cover 56.

Likewise, a box-shaped rear shield cover 59 covering the rear face of the audio signal processing circuit board 32 is provided at the rear side of the audio signal processing circuit board 32, whereby the respective circuits mounted on the rear face of the audio signal processing circuit 32 are protected.

In this embodiment, the shield covers 56 and 59 are formed of material having high thermal conductivity, and the reason for this will be described later.

Furthermore, as shown in FIG. 1(A), sixteen output terminals 60 are provided to the audio signal processing circuit board 32 and arranged in the peripheral direction of the audio signal processing circuit board 32 so as to project to the outside of the disc-shaped audio signal processing circuit board 32.

Describing the arrangement of the output terminals 60 in detail, the output terminals 60 are provided so that they are divided into groups each comprising eight output terminals 60 and arranged line-symmetrically with respect to a virtual straight line T1 connecting the upper bridge 29 and the lower bridge 30 as an axis of symmetry as shown in FIG. 1(A). In each group, the eight output terminals 60 are arranged at an equal interval (at equally angular interval from the center axis L1). That is, the respective sixteen output terminals 60 are arranged at equal intervals on substantially the same circle with avoiding the connection portion between the bridges 29, 30 and the audio signal processing circuit board 32.

The output terminals 60 are directly connected to the electrical connection point of the audio signal processing circuit board 32.

Both the ends of the tinsel wire 61 constituting the voice coil 22 are connected to each of the output terminals 60. Specifically, the tinsel wires 61 are directly connected to through holes 62 (FIG. 2) formed in the output terminals 60 by soldering. As described above, the tinsel wires 61 are connected to the through holes 62 of the output terminals 60 connected to the electrical contact points of the audio signal processing circuit board 32, so that the workability for connecting the tinsel wires 61 to the audio signal processing circuit board 32 is very excellent. Furthermore, a terminal board which is exclusively provided with terminals for connecting the tinsel wires 61 to the audio signal processing circuit board 32 is not required to be provided separately from the audio signal processing circuit board 32, the production cost can be reduced and the working efficiency can be increased.

In this embodiment, a driving signal for driving the bobbin 21 is output from the audio signal processing circuit board 32 to each voice coil 22, the bobbin 21 is vibrated by the respective voice coils 22 in accordance with the driving signal, and the diaphragm 24 is vibrated in connection with the vibration of the bobbin 21, whereby sounds are output.

Here, the audio signal processing circuit board 32 will be described in detail.

The audio signal processing circuit board 32 is a digital circuit board on which a circuit for subjecting an input digital audio signal to digital processing to generate a driving signal for the voice coil 22 of each layer and outputting the driving signal is mounted.

The circuit mounted on the audio signal processing circuit 32 contains a $\Delta\Sigma$ modulation circuit, a predetermined filter circuit, a digital amplifier, etc. These circuits are constructed by digital circuits, and thus they are configured to be remarkably small in size as compared with a case where these circuits are constructed by analog circuits. Particularly, the digital amplifier is remarkably smaller than an analog amplifier, and an amplifier circuit 64 for signal amplification which constitutes the digital amplifier can be disposed on the back surface of the audio signal processing circuit board 32 with a margin as shown in FIG. 2. This amplifier circuit 64 has six digital amplifiers to amplify the driving signal for the voice coils 22 of the respective layers (six layers in this construction).

Here, as described above, each of the front shield cover 56 and the rear shield cover 59 is constructed by a material having a high thermal conductivity. According to this construction, heat generated from the respective circuits containing the amplifier circuit 64 is conducted to the shield covers 56 and 59 to cool the respective circuits, and air is blown to the shield covers 56 and 59 in connection with the vibration of the bobbin 21 and the diaphragm 24 which is caused by the driving of the voice coil speaker 1, thereby promoting cooling of the shield covers 56 and 59.

The voice coil speaker 1 according to this embodiment has the audio signal processing circuit board 32 on which all the circuits containing the amplifier circuit 64 for signal amplification for the input digital audio signal are mounted. Therefore, it is unnecessary to interpose a power amplifier or the like at the front stage of the voice coil speaker 1, and a speaker amplification system is constructed by the voice coil speaker 1 alone. Accordingly, space saving which is particularly required to an in-vehicle mount speaker can be implemented.

Here, multi-channel audio signals are input from external equipment connected to the connector 36 to the audio signal processing circuit board 32 according to this embodiment, and the audio signal processing circuit 32 executes signal processing such as predetermined sampling processing, predetermined filtering processing, etc. on the input multi-channel audio signals to output the sounds corresponding to the multi-channel audio signals. Therefore, the audio signal processing circuit 32 generates the driving signal to be output to each voice coil 22, and outputs the generated driving signal to each voice coil 22 through each tinsel wire 61 connected to the output terminal 60.

In this embodiment, the voice coils 22 of the bobbin 21 are multilayered in accordance with the number of the channels of the audio signal input to the audio signal processing circuit board 32.

As described above, the voice coil speaker 1 according to this embodiment is configured so that the multilayer voice coils 22 are formed on the bobbin 21 and the tinsel wires 61 from the voice coils are connected to the audio signal processing circuit board 32. Therefore, it is required that many tinsel wires 61 are surely prevented from interfering with one another. In order to satisfy this requirement, the voice coil speaker 1 according to this embodiment has the following construction.

That is, as shown in FIG. 2, the diameter of the tip portion 47 of the sub damper 45 (=the maximum diameter of the sub damper 45) is substantially equal to the diameter of a virtual circle formed by connecting the through holes 62 of the output terminals 60, and each of the tinsel wires 61 linearly extends from each of the through holes 62 of the output terminals 60 to the bobbin 21 along the surface of the sub damper 45. At this time, as shown in FIG. 1(B) and FIG. 2, the tinsel wire 61 is interwoven with the sub damper 45 at plural places thereof so as to extend linearly to the bobbin 21 while fixed in close contact with the sub damper 45.

As described above, the tinsel wires 61 are configured to extend linearly from the output terminals 60 to the bobbin 21, and the tinsel wires 61 are interwoven with the sub damper 45 to be fixed and brought into close contact with the sub damper 45. Therefore, the tinsel wires 61 can be positioned while the length of each tinsel wire 61 between the output terminal 60 and the bobbin 21 is reduced.

Therefore, the moving range of the tinsel wires 61 when the bobbin 21 vibrates can be narrowed, and the tinsel wires 61 can be prevented from interfering with one another. Furthermore, when the voice coil speaker 1 is fixed to the side surface of a door of the vehicle, there occur various vibrations such as vibration caused by opening/closing of the door, vibration caused by driving of the engine, vibration caused by running of the vehicle, etc. However, even when such vibration occurs, the interference of the tinsel wires 61 can be prevented. From this viewpoint, the voice coil speaker 1 is suitable for an in-vehicle mount speaker.

Furthermore, the output terminals 60 are arranged on substantially the same circle so as to be spaced from one another at equal intervals on the audio signal processing circuit board 32 while avoiding the connection portions between the board and the bridges 29, 30, and the tinsel wires 61 are configured to extend from the respective output terminals 60 arranged on substantially the same circle to the bobbin 21. Accordingly, the tinsel wires 61 are interwoven with the sub damper 45 radially around the center axis L1 and at substantially equal angular intervals. As described above, the tinsel wires 61 are interwoven radially and at the equal angular intervals, whereby the physical distance interposing between the respective tinsel wires 61 can be secure most efficiently, and the interference among the tinsel wires 61 can be more effectively prevented.

As described above, the voice coil speaker 1 according to this embodiment has a speaker body 11 which is provided with the bobbin 21 having the multilayer voice coils 22 formed thereon and the diaphragm 24 connected to the bobbin 21. Furthermore, the audio signal processing circuit board 32 for processing audio signals is disposed ahead of the diaphragm 24, and the plural output terminals 60 for outputting to the multilayer voice coils 22 are arranged in the peripheral direction of the audio signal processing circuit board 32.

According to this embodiment, in the voice coil speaker 1 of this embodiment, the audio signal processing circuit board 32 as an indispensable constituent element that can process multi-channel audio signals can be disposed by effectively practically using the space at the front side of the diaphragm 24.

Furthermore, in this embodiment, the plural output terminals 60 are arranged at equal intervals in the peripheral direction of the audio signal processing circuit board 32.

More specifically, the plural output terminals 60 are arranged at equal intervals on substantially the same circle on the audio signal processing circuit board 32.

According to this construction, the respective output terminals 60 can be arranged to be efficiently spaced from one another. In connection with this, the physical distance between the respective tinsel wires 61 connected to the output terminals 60 can be efficiently secured, so that the interference among the tinsel wires 61 can be suitably prevented.

In this embodiment, the sub damper 45 is provided between the bobbin 21 and the bridges 29, 30 (frames) for supporting the audio signal processing circuit board 32, and the tinsel wires 61 are provided so as to extend from the plural output terminals 60 of the audio signal processing circuit board 32 to the multilayer voice coils 22 formed on the bobbin 21 along the sub damper 45.

According to this construction, the tinsel wires 61 are arranged so as to linearly extend from the output terminals 60 to the bobbin 21 along the sub damper 45, the length of each tinsel wire 61 between each output terminal 60 and the bobbin 21 can be shortened, and the interference among the tinsel wires 61 can be prevented.

Still furthermore, in this embodiment, the tinsel wires 61 are arranged so as to extend from the output terminals 60 to the bobbin 21 under the state that the tinsel wires 61 are interwoven with the sub damper 45.

Accordingly, the tinsel wires 61 extend linearly to the bobbin 21 under the state that the tinsel wires 61 are fixed to and brought into close contact with the sub damper 45, so that the length of the tinsel wires 61 can be shortened and the interference of the tinsel wires 61 can be prevented. Furthermore, the moving range of the tinsel wires 61 when the bobbin 21 vibrates can be more greatly narrowed, and the interference among the tinsel wires 61 can be prevented. Furthermore, when the voice coil speaker 1 is fixed to the side surface of the door of the vehicle, there occur various vibrations such as vibration caused by opening/closing of the door, vibration caused by driving of the engine, vibration caused by running of the vehicle, etc. However, even when such vibration occurs, the interference of the tinsel wires 61 can be prevented. From this viewpoint, the voice coil speaker 1 is suitable for an in-vehicle mount speaker.

In this embodiment, the tinsel wires 61 are radially interwoven in the sub damper 45.

According to this construction, the tinsel wires 61 can be positioned so that the physical distances of the tinsel wires 61 can be most efficiently secured, and the interference of the tinsel wires 61 can be more effectively prevented.

Furthermore, in this embodiment, the audio signal processing circuit board 32 is covered by the shield covers 56 and 59.

Accordingly, the audio signal processing circuit board 32 is protected by the shield covers 56 and 59. Furthermore, as described above, the shield covers 56 and 59 are members having high thermal conductivity, and the circuits mounted on the audio signal processing circuit board 32 can be cooled by the shield covers 56 and 59.

Still furthermore, in this embodiment, the amplifier circuit 64 for amplifying audio signals is mounted on the audio signal processing circuit board 32.

Here, the amplifier circuit 64 is a member indispensable for the voice coil speaker 1 according to this embodiment, and saving of space is implemented by mounting the amplifier circuit 64 on the audio signal processing circuit board 32 which is likewise an indispensable member. Furthermore, in this embodiment, the respective circuits mounted on the audio signal processing circuit board 32 can be cooled, and the amplifier circuit 64 can be cooled by mounting the amplifier circuit 64 on the audio signal processing circuit board 32.

In this embodiment, the multi-channel audio signal is input to the audio signal processing circuit board 32, and the audio signal processing circuit board 32 executes the signal processing corresponding to the multi-channel audio signal, outputs the driving signal to the voice coil 22 through the interference-prevented tinsel wires 61 to vibrate the bobbin 21, whereby the sounds associated with the multi-channel audio signal can be properly output.

Furthermore, in this embodiment, the band-shaped bridges 29 and 30 (frames) are bridged at the front portion of the speaker body 11, whereby the audio signal processing circuit board 32 is supported by the bridges 29 and 30.

According to this construction, the audio signal processing circuit board 32 can be surely and firmly supported at the front side of the diaphragm 24 under the state that the opening portion of the speaker opening 10 can be secured at maximum.

Still furthermore, in this embodiment, the tweeter 50 is disposed at the front side of the audio signal processing circuit 32, and the driving signal is output from the audio signal processing circuit board 32 to the tweeter 50, whereby sounds can be output by using the tweeter 50.

The above-described embodiment is merely an example of the present invention, and any modification and application may be performed within the scope of the present invention.

For example, in the above-described embodiment, the sixteen output terminals 60 are provided to the audio signal processing circuit board 32, and the tinsel wire 61 is connected to each of the output terminals 60. However, the number of the output terminals 60 and the number of the tinsel wires are not limited to this embodiment. That is, the present invention is broadly applicable to a voice coil speaker 1 which is provided with plural tinsel wires 61 in connection with the formation to the multilayer voice coils 22 on the bobbin 21.

Furthermore, the audio signal processing circuit board 32 according to this embodiment is designed in a disc-shape, but it may be designed in an annular shape.

DESCRIPTION OF REFERENCE NUMERALS

1 voice coil speaker
11 speaker body
13 speaker frame (frame)
21 bobbin
22 voice coil
24 diaphragm
29 upper bridge (frame)
30 lower bridge (frame)
32 audio signal processing circuit board (circuit board)
45 sub damper (damper)
50 tweeter
56 front shield cover (shield cover)
59 rear shield cover (shield cover)
60 output terminal
61 tinsel wire
62 through hole
64 amplifier circuit

The invention claimed is:

1. A digital voice coil speaker comprising:

a bobbin having multilayer voice coils formed thereon;

a diaphragm connected to the bobbin and increasing in diameter toward a front side, the bobbin and the diaphragm being provided in a speaker body;

a band-shaped frame provided at the front side of the diaphragm;

a circuit board for processing an audio signal fixed to the frame;

a damper provided between the bobbin and the band shaped frame that supports the circuit board;

a plurality of output terminals for outputting to the multilayer voice coils that are arranged and separated from one another at an equal interval in the circuit board on substantially a same circle having a center axis that is coincident with a center axis of the bobbin, and are arranged line-symmetrically with respect to the band-shaped frame; and each of a plurality of tinsel wires connected to each of the plurality of output terminals, each of the plurality of tinsel wires extending from the plurality of output terminals to the multilayer voice coils radially around the center axis of the bobbin.

2. The digital voice coil speaker according to claim 1, wherein the plurality of output terminals are divided into two groups and arranged line-symmetrically with respect to the band-shaped frame, and each of the plurality of output terminals belonging to each group is arranged so as to be spaced apart from one another at equal intervals.

3. The digital voice coil speaker according to claim 1, wherein the plurality of output terminals are arranged on substantially the same circle so as to be spaced from one another at an equal interval.

4. The digital voice coil speaker according to claim 1, further comprising tinsel wires connecting the plurality of output terminals and the voice coils are interwoven with the damper.

5. The digital voice coil speaker according to claim 1, wherein at least a portion of the circuit board is disposed in a space that is formed by the diaphragm increasing in diameter and that is located at the front side of the diaphragm.

6. The digital voice coil speaker according to claim 1, wherein the circuit board is covered by a shield cover.

7. The digital voice coil speaker according to claim 1, wherein an amplifier circuit for amplifying an audio signal is mounted on the circuit board.

8. The digital voice coil speaker according to claim 1, wherein multi-channel audio digital signals are input to the circuit board.

9. The digital voice coil speaker according to claim 1, wherein the band-shaped frame is bridged ahead of the speaker body so that the circuit board is supported by the frame.

10. The digital voice coil speaker according to claim 1, wherein a tweeter is disposed ahead of the circuit board.

11. The digital voice coil speaker according to claim 2, wherein the plurality of output terminals are arranged on substantially the same circle so as to be spaced from one another at an equal interval.

12. The digital voice coil speaker according to claim 3, wherein each of the plurality of the tinsel wires are provided so as to extend from the plurality of output terminals of the circuit board along the damper to the multilayer voice coils formed on the bobbin.

13. The digital voice coil speaker according to claim 5, wherein the circuit board is covered by a shield cover.

14. The digital voice coil speaker according to claim 6, wherein an amplifier circuit for amplifying an audio signal is mounted on the circuit board.

15. The digital voice coil speaker according to claim 7, wherein multi-channel audio digital signals are input to the circuit board.

16. The digital voice coil speaker according to claim 8, wherein the band-shaped frame is bridged ahead of the speaker body so that the circuit board is supported by the frame.

17. The digital voice coil speaker according to claim 9, wherein a tweeter is disposed ahead of the circuit board.

18. The digital voice coil speaker according to claim 1, wherein the frame further comprises a pair of bridges formed in a band-shape, the bridges are arranged line-symmetrically with respect to a center axis of the bobbin, and the circuit board is fixed to each of the bridges at a substantially center of an opening portion of a speaker opening.

19. The digital voice coil speaker according to claim 1, further comprising an end portion of the bobbin at the front side that extends from a base portion of the diaphragm at a rear side and is located inside the diaphragm.

20. The digital voice speaker according to claim 1, wherein each of the plurality of the tinsel wires are provided so as to extend from the plurality of output terminals of the circuit board along the damper to the multiplayer voice coils formed on the bobbin.

* * * * *